US005169035A

United States Patent [19]

Imbery, Jr.

[11] Patent Number: 5,169,035

[45] Date of Patent: Dec. 8, 1992

[54] SQUEEZE BOTTLE DISPENSING CLOSURE WITH VENT VALVE

[75] Inventor: Leo R. Imbery, Jr., Crystal Lake, Ill.

[73] Assignee: Seaquist Closures a division of Pittway Corporation, Mukwonago, Wis.

[21] Appl. No.: 703,403

[22] Filed: May 21, 1991

[51] Int. Cl.[5] ..... B65D 37/00

[52] U.S. Cl. ..... 222/212; 222/481.5; 222/546

[58] Field of Search ..... 222/212, 481.5, 546, 222/481

[56] References Cited

U.S. PATENT DOCUMENTS

| | | | |
|---|---|---|---|
| 1,296,341 | 3/1919 | Towle | 222/481 |
| 2,128,128 | 11/1936 | Evans | 215/56 |
| 3,022,918 | 6/1960 | Smith | 215/56 |
| 3,043,463 | 9/1959 | Beall | 215/56 |
| 3,173,589 | 2/1963 | Dike | 222/479 |
| 3,390,821 | 7/1968 | Mullan | 222/518 X |
| 3,655,102 | 4/1972 | Maran | 222/546 Y |
| 3,726,442 | 4/1973 | Davidson et al. | 222/481.5 X |
| 3,851,588 | 12/1974 | Taylor | 215/56 X |
| 4,057,177 | 11/1977 | Laavwe | 222/481.5 X |
| 4,408,702 | 10/1983 | Horvath | 222/212 |
| 4,420,101 | 12/1983 | O'Neill | 222/212 |
| 4,646,945 | 3/1987 | Steiner et al. | 222/212 X |
| 4,658,979 | 4/1987 | Mietz et al. | 220/209 |
| 4,747,518 | 5/1988 | Laauwe | 222/153 |
| 4,760,937 | 8/1988 | Evezich | 222/212 X |
| 4,782,985 | 11/1988 | Kinsley | 222/481.5 |
| 4,785,928 | 11/1988 | Kano et al. | 222/482 |
| 4,921,071 | 5/1990 | Lonnborg et al. | 184/6.4 |
| 4,993,606 | 2/1991 | Bolen, Jr. et al. | 222/546 |
| 5,002,209 | 3/1991 | Goodall | 222/481.5 |
| 5,005,737 | 4/1991 | Rohr | 222/212 |

FOREIGN PATENT DOCUMENTS

| | | | |
|---|---|---|---|
| 803399 | 1/1969 | Canada | 222/212 |
| 9221188 | 3/1963 | United Kingdom | 222/546 |
| 2198418 | 6/1988 | United Kingdom | 222/212 |

OTHER PUBLICATIONS

"Product Profile" for Concept 2000 (1 sheet) Jun. 29, 1988.

*Primary Examiner*—Andres Kashnikow
*Assistant Examiner*—Kenneth Bomberg
*Attorney, Agent, or Firm*—Dressler, Goldsmith, Shore, Sutker & Milnamow

[57] ABSTRACT

A closure is provided for use in a squeeze-type container that defines a discharge opening communicating with the container interior in which the fluid product is contained. The closure includes a body for being mounted to the container over the container opening. An insert member is mounted in the body. In one embodiment, the insert member defines a dispensing orifice through which the container contents can be dispensed, and the closure body defines a vent aperture adjacent the insert member for cooperating with the insert member to define a vent passage between the container opening and the ambient atmosphere. A resilient sealing lip is defined by the insert member for sealingly engaging the interior surface of the closure body around the vent aperture in a closed position. The sealing lip is shifted out of sealing engagement to an open position when the ambient atmospheric pressure exceeds the pressure within the container, and this permits equalization of the container pressure the ambient atmospheric pressure. A lid is provided for being moved to a closed position on the closure body, and the lid has a plug member for being sealingly received in the dispensing orifice of the insert member to occlude the dispensing orifice. In another embodiment, the dispensing orifice and vent aperture are separately defined within, and by, the closure body.

14 Claims, 2 Drawing Sheets

Fig. 1
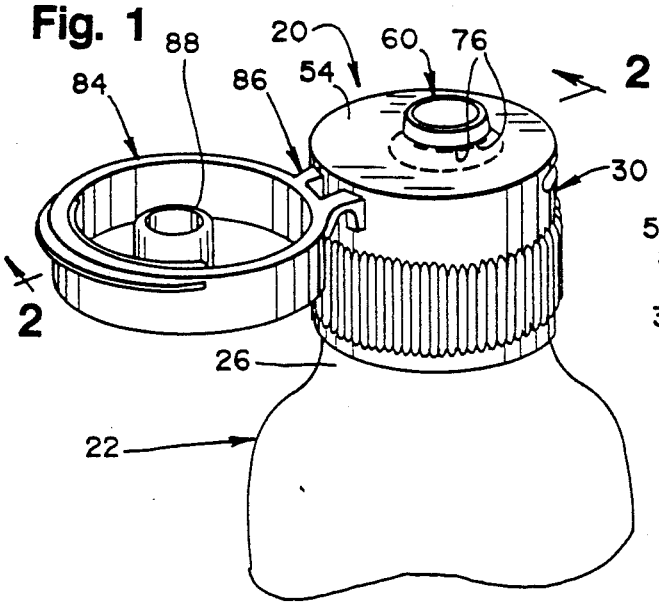
Fig. 3
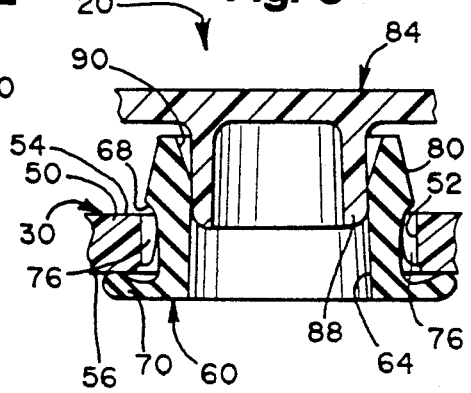
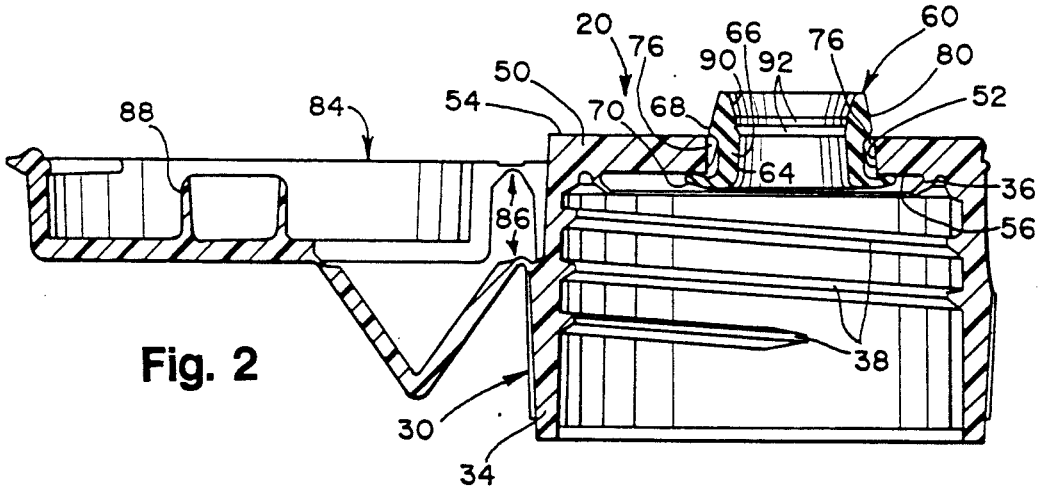
Fig. 2
Fig. 4
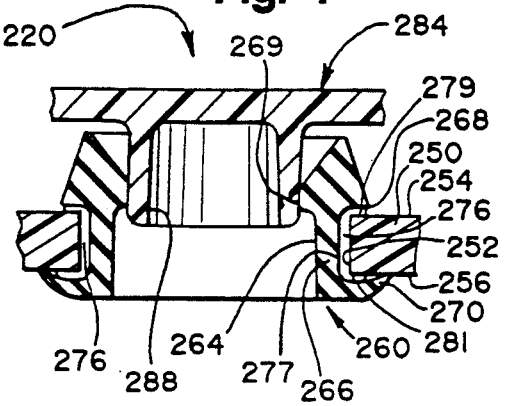
Fig. 5
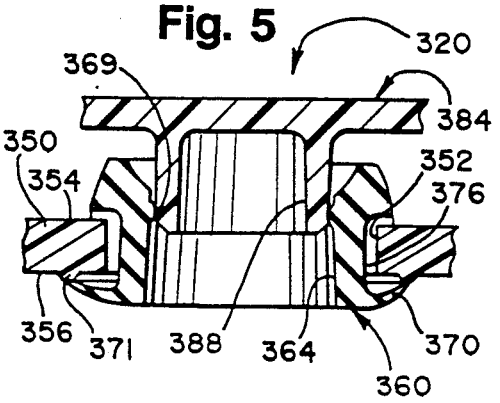

SQUEEZE BOTTLE DISPENSING CLOSURE WITH VENT VALVE

TECHNICAL FIELD

This invention relates to container closures, and more particularly to squeeze bottle dispensing closures of the type which can be opened to permit dispensing of a fluid product from the bottle when the bottle is squeezed

BACKGROUND OF THE INVENTION AND TECHNICAL PROBLEMS POSED BY THE PRIOR ART

A variety of packages, including dispensing packages or containers, have been developed for personal care products such as shampoo, lotions, etc., as well as for other fluid materials.

A popular package design is the squeeze bottle or flexible container which is intended to be squeezed by the user to dispense the product. Such a container typically includes a closure through which the product is dispensed.

In some designs, the closure incorporates a movable member, such as a lid, which can be positioned to open or close a dispensing orifice.

Squeezable containers can also be provided with a closure that permits venting of air into the container to equalize the inside and outside pressures when the squeezing forces are removed from the container. See for example, U.S. Pat. No. 5,009,737.

Changes in atmospheric pressure can affect a squeeze bottle package prior to being delivered to a user. In particular, a flexible squeeze bottle can suffer a partial, inward collapse when the atmospheric pressure increases or when it is subjected to an accidental impact that partially compresses the container and forces some air out of the container. Unless a venting system is provided to permit equalization of the sub-atmospheric pressure in the container with the ambient atmospheric pressure, the squeeze bottle package can remain partially collapsed This can be a source of complaints from consumers who purchase such squeeze bottle packages.

In view of this, it would be desirable to provide an improved squeeze bottle package with a venting system to permit the pressure within the bottle to be equalized with the ambient atmospheric pressure.

Further, it would also be beneficial to provide such an improved squeeze bottle package venting system with means for preventing accidental discharge of the container contents. In particular, such an improved package should not permit significant leakage or discharge of the product during shipping when the container is subjected to external impact forces.

When dispensing closures are employed in packages for personal care product liquids, especially relatively viscous liquids, there is a tendency for the venting passages and dispensing orifice to become occluded or partially blocked with the liquid or with dried, or partially dried, residue that remains on the closure after a portion of the liquid has been dispensed from the package. Thus, it would be advantageous if an improved closure could be provided with a design that is less susceptible to such blockage and/or which includes means for minimizing or correcting blockage problems.

In some applications, a dispensing closure must be operated many hundreds or thousands of times. Repeated and severe flexing of some resilient closure materials might eventually cause failure of the materials or loss of the desired resiliency. Thus, it would be beneficial to provide an improved dispensing closure for a squeeze bottle package which would operate with a reduced flexure movement and with reduced stresses so as to provide a relatively greater life cycle.

Further, the employment of an improved dispensing closure configuration that operates with reduced flexure and with reduced stresses should desirably permit the fabrication of the closure from relatively inexpensive materials that might otherwise be susceptible to tearing or other failure after a large number of operation cycles.

The present invention provides an improved closure which can accommodate designs having the above-discussed benefits and features.

SUMMARY OF THE INVENTION

This invention provides an improved dispensing device for dispensing flowable materials. The invention is embodied in a closure provided for use in a squeeze-type container that defines a discharge opening communicating with the container interior in which the fluid product is contained.

The closure permits inspiration of ambient atmospheric air to equalize sub-atmospheric pressure in the container with the ambient atmospheric pressure. Thus, a collapsed, resilient container can return to its substantially undeformed, or original, shape after applied squeezing forces have been removed.

With this invention, an increase in ambient atmospheric pressure will cause the closure to vent the higher pressure ambient air into the container to equalize the container interior pressure with the ambient atmospheric pressure and thereby prevent partial collapse of the container. Thus, the closure of the present invention, when employed with a squeeze bottle type container, will eliminate or substantially reduce the tendency of the container to remain in a partially collapsed condition following normal use, following changes in ambient atmospheric pressure, or following shipping impacts Further, the closure provides a tight seal on the container to prevent unwanted leakage or discharge of the product when the closure is in a closed orientation on the container. Additionally, operation of the closure (from a closed to an open orientation and/or from an open to a closed orientation) is effective to clean the closure to prevent blockage or occlusion of the venting system.

The closure includes a body for being mounted to the container over the container opening. The body has an interior surface for being disposed at the container opening.

An insert member is mounted in the body. In a first embodiment, the insert member defines a dispensing orifice through which the container contents can be dispensed, and the closure body defines a vent means adjacent the insert member for cooperating with the insert member to define a vent passage between the container opening and the ambient atmosphere. In a preferred form of this first embodiment, the vent means is defined in the closure body as a vent aperture around the insert member, and spaced-apart ribs project inwardly from the outer periphery of the vent aperture to engage the exterior of the insert member.

A resilient sealing means is defined by the insert member for sealingly engaging the interior surface of the closure body around the vent passage in a closed position. The sealing means is shifted out of sealing engagement with the interior surface when the ambient atmospheric pressure exceeds the pressure within the container, and this permits equalization of the container pressure with the ambient atmospheric pressure.

A lid is provided for being moved to a closed position on the closure body, and the lid has a plug member for being sealingly received in the dispensing orifice of the insert member to occlude the dispensing orifice.

In a second embodiment, the insert member per se does not define a dispensing orifice. Rather, the dispensing orifice is separately defined in the closure body, and the insert member is mounted in a vent aperture at a location spaced from the dispensing orifice. The closure body defines a plurality of spaced-apart ribs projecting inwardly from the outer periphery of the vent aperture around the insert member. The insert member has a stem extending through the vent aperture, a shoulder at one end of the stem for engaging the closure body to prevent displacement of the insert member inwardly relative to the container opening, and a resilient sealing means at the other end of the stem for sealingly engaging a valve seat on the closure body in a closed position. The sealing means is shifted out of sealing engagement with the valve seat to an open position when the ambient atmospheric pressure exceeds the pressure in the container, and this permits equalization of the container pressure with the ambient atmospheric pressure. A lid is provided for being moved to a closed position on the closure body to sealingly occlude the dispensing orifice.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same, FIG. 1 is a fragmentary, perspective view of a first embodiment of the invention in the form of a fluid dispensing closure shown mounted on a squeeze-type container with the closure lid in an open position relative to the closure body or base;

FIG. 2 is an enlarged, cross-sectional view of the closure shown in FIG. 1;

FIG. 3 is a more greatly enlarged, fragmentary, cross-sectional view similar to FIG. 2 but showing the lid in a closed position;

FIG. 4 is a view similar to FIG. 3 but showing a second embodiment of the invention;

FIG. 5 is a view similar to FIG. 3 but showing a third embodiment of the invention;

DESCRIPTION OF THE PREFERRED EMBODIMENTS

Figure 6:
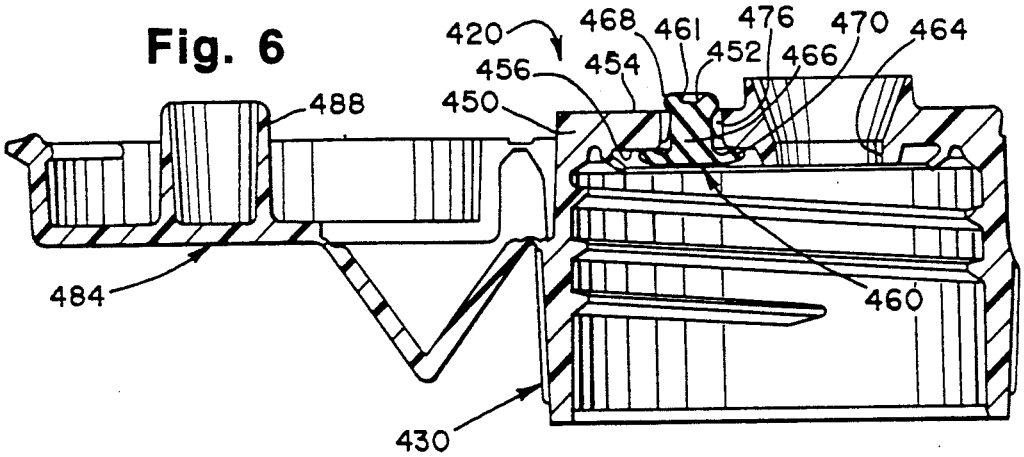
FIG. 6 is a view similar to FIG. 2 but showing a fourth embodiment of the invention.

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, the closure of this invention is described in the normal (upright) operating position, and terms such as upper, lower, horizontal, etc., are used with reference to this position. It will be understood, however, that the closure of this invention may be manufactured, stored, transported, used, and sold in an orientation other than the position described.

Some of the figures illustrating embodiments of the apparatus show structural details that will be recognized by one skilled in the art. However, the detailed descriptions of such structural details are not necessary to an understanding of the invention, and accordingly, are not herein presented.

With reference now to the figures, the first embodiment of the closure of the present invention is represented generally by a reference numeral 20 in FIGS. 1–3. The closure 20 is adapted to be disposed on a container, such as the container 22 which has a conventional mouth or opening defined by a neck 26 or other suitable structure. The closure 20 may be fabricated from a thermoplastic material, or other materials, compatible with the container contents.

As best illustrated in FIGS. 1 and 2, the closure 20 includes a base, housing, or body 30 for securement to the container 22. In the illustrated embodiment, the body 30 includes a peripheral wall in the form of a cylindrical side wall or skirt 34.

As best illustrated in FIG. 2, the body 30 includes an internal sealing ring 36 which functions as a seal and protrudes against or into the container neck 26 for engaging a peripheral surface of the neck 26 so as to effect a tight seal.

Further, as best illustrated in FIG. 4, the body skirt 34 includes, on its interior surface, a conventional thread 38 or other suitable connecting means (e.g., a snap-fit bead (not illustrated)) for engaging suitable cooperating means, such as a thread (not illustrated) on the container neck 26 so as to releasably secure the housing 30 to the container 22.

In the preferred embodiment illustrated in FIGS. 1–3, the closure body 30 includes a top wall or deck 50 defining a cylindrical vent aperture 52 (FIG. 2). As best illustrated in FIGS. 1 and 2, the deck 50 has an exterior, or upper, surface 54 and an interior, or lower, surface 56 facing the interior of the container 22. The body 30 may be molded from a suitable thermoplastic material such as, for example, polypropylene.

The closure 20 further includes an insert member 60 mounted within the vent aperture 52 of the body 30. The insert member 60 may be fabricated from an elastomeric polymer or other suitable material. In a presently contemplated embodiment, the member 60 is molded from low density polyethylene.

The insert member 60 has a generally annular configuration and defines a dispensing orifice 64. Preferably, the vent aperture 52 is generally circular and the dispensing orifice 64 is generally circular. The vent aperture 52 and the dispensing orifice 64 are preferably coaxial.

The insert member 60 is suitably retained within the body deck 50. Preferably, the insert member includes (1) a stem 66 extending through the vent aperture 52, (2) a shoulder 68 at the outer end of the stem 66 for engaging the closure body 30 to prevent displacement of the insert member inwardly relative to the container opening, and (3) a resilient sealing means in the form of an annular lip 70 for sealingly engaging the closure body interior surface 56 when the annular lip 70 is in a closed position as illustrated in FIGS. 2 and 3. The region of the interior surface 56 around the vent aperture 52, where the surface 56 is contacted by the lip 70, defines a valve seat or seating surface.

In the preferred form of the first embodiment of the invention illustrated in FIGS. 1-3, the closure body 30 defines a plurality of spaced-apart ribs 76 which project inwardly from the outer periphery of the aperture. In the illustrated embodiment, the ribs 76 are circumferentially disposed around the insert member 60 in an equally spaced circular array. The tops of the ribs 76 are engaged by the insert member shoulder 68. This engagement prevents inward displacement of the insert member 60.

The exterior upper end of the insert member 60 defines a frustoconical surface 80 which slants away from the shoulder 68 inwardly toward the center of the insert member. It will be recognized that each rib 76 also has a similar slanting configuration. Thus, the insert member 60 can be inserted into the closure body deck 50 from the interior of the closure body so that the frustoconical surface 80 slides along the slanting surfaces of each rib 76. This causes a temporary compression of the insert member 60 sufficient to permit the shoulder 68 to slide past the ribs 76. When the shoulder 68 clears the ribs 76, the shoulder 68 expands outwardly to a less stressed condition owing to the inherent resiliency of the insert member material.

Preferably, the stem 66 of the insert member 60 remains under some amount of circumferential compression so as to provide an even more secure mounting of the insert member within the vent aperture 52.

The vent aperture 52 functions as a vent means for cooperating with the insert member 60 to define passages along the ribs 76 between the container opening and the ambient atmosphere. However, these vent passages are occluded by the annular sealing lip 70 which sealingly engages the interior surface 56 of the closure body around the periphery of the vent aperture 52. To this end, the insert member 60 is typically molded so that the annular lip 70 has an upwardly projecting configuration.

The length (i.e., the height) of the stem 66 between the shoulder 68 and the lip 70 is preferably selected so that there is some downward flexing or bending of the annular lip 70 when the insert member 60 is properly mounted within the vent aperture 52. This will maintain the lip 70 in engagement with the closure body surface 56 under some amount of pre-load stress to ensure normal sealing of the vent passage.

However, when the ambient atmospheric pressure exceeds the pressure within the container, the annular lip 70 will be deflected downwardly, and out of engagement with the closure body surface 56, to permit equalization of the container pressure with the ambient atmospheric pressure. Such conditions could occur after the container has been squeezed to dispense some of the contents or during shipping when the ambient atmospheric pressure is increased due to normal weather patterns. Also, if the container 22 is subjected to an impact during shipping, and some of the air within the container is forced out, then the ambient atmosphere will vent into the container and restore the container to the original, undeformed condition. Of course, such venting of air into the container will also occur after a user dispenses the product through the container during normal use.

The closure 20 includes a cover or lid 84. In the embodiment illustrated in FIGS. 1-3, the cover 84 is illustrated as being connected to the side of the closure base 30. It will be understood, however, that the cover or lid 84 may be a separate component adapted for being disposed on the closure base 30 in a closed condition and for being removed from the closure base 30 to open the closure.

In the preferred form, where the lid 84 is connected to the closure base 30, the lid 84 is preferably molded as a unitary part of the closure 20. The lid 84 may be connected with a unitary snap-action hinge 86 as illustrated in FIGS. 1 and 2. Such a snap-action hinge 86 may be of the conventional type described in the U.S. Pat. No. 4,964,539. Other types of hinges, including other types of snap-action hinges, may be employed instead.

The lid 84 includes a closure spud or plug member 88 for being sealingly received in the insert member dispensing orifice 64. Preferably, the insert member dispensing orifice 64 has a generally circular, transverse cross section, and the closure plug member 88 has a generally cylindrical exterior surface for interferingly mating with the insert member 60 in the orifice 64.

Preferably, the upper, outlet end of the insert member 60 has a tapered or frustoconical surface 90 to guide the plug member 88 into the orifice 64. When the plug member 88 is properly inserted in the insert member 60, there is some compression of the wall thickness of the stem 66 between the plug member 88 and the surrounding ribs 76. This aids in providing an even greater sealing capability to prevent the container contents from being inadvertently discharged through the dispensing orifice 64 when the lid 84 is closed. Further, the compression of the wall of the stem 66 between the plug member 88 and the ribs 76 provides an increased engagement of the insert member shoulder 68 with the ribs 76 so as to ensure that the insert member 60 will not be forced downwardly and out of the closure body vent aperture 52.

If desired, and as illustrated in FIG. 2, the insert member 60 may be provided with an annular recess or shallow channel 92 at the lower end of the frustoconical surface 90 for accommodating a portion of the plug member 88 and for enhancing the sealing engagement between the plug member 88 and the insert member 60.

When the lid 84 is opened, the frictional forces created by the movement of the plug member 88 out of the insert member 60 can cause a slight elongation or stretching of the insert member stem 66. This causes the shoulder 68 to be moved upwardly a small amount relative to the closure body deck top surface 52. Also, the upward movement of the stem 66 may tend to pull the annular lip 70 radially inwardly a small amount—but not enough to interrupt or interfere with the sealing engagement between the lip 70 and the closure body deck interior surface 56. The slight movement of the annular lip 70, as well as of the shoulder 68, may advantageously loosen or break up dried product that may have accumulated and that might otherwise tend to block the vent passageway.

In any event, the mounting of the insert member 60 within the vent aperture 52 is preferably sufficiently secure so that there is no substantial gross axial movement of the insert member 60 per se relative to the vent aperture 52 during the movement of the lid 84 into and out of the closed position. While portions of the insert member 60 may be additionally compressed during insertion of the plug member 88 and may be elongated during removal of the plug member 88, the insert member 60 remains securely mounted within the vent aperture 52. Thus the sealing lip 70, when not subjected to a differential pressure, remains in sealing engagement with the closure body deck interior surface 56.

Alternate embodiments of the closure of the present invention are illustrated in FIGS. 4–10 wherein the structural elements are designated generally by three digit numbers. Elements of each of the alternate embodiments that are identical or functionally analogous to the elements of the first embodiment illustrated in FIGS. 1–3 are designated by reference numbers in which the last two digits are identical to the two digits of the reference number of the identical or functionally analogous element in the first embodiment.

FIG. 4 illustrates a second embodiment of the invention wherein the closure is designated generally by the reference numeral 220. The closure 220 includes a closure body which defines a deck 250 for extending over the opening of the container (not visible in FIG. 4). The deck 250 has an exterior surface 254 and an interior surface 256. The deck 250 defines a vent aperture 252 for receiving an insert member 260. The insert member 260 defines a dispensing orifice 264, a stem 266, a retaining shoulder 268, and a resilient sealing means or lip 270.

The closure body deck 250 defines a plurality of circumferentially spaced-apart ribs 276 which engage the exterior of the insert member stem 266. Vent passages are defined along the ribs 276 between the outer periphery of the vent aperture 252 and the exterior surface of the insert member 260.

The closure 220 further includes a lid 284 having a plug member 288 for being sealingly received in the dispensing orifice of the insert member 260.

The dispensing orifice 264 is generally cylindrical, but the insert member 260 defines an inwardly projecting annular shoulder 269 for sealingly engaging the exterior surface of the plug member 288 which, in this embodiment, is also cylindrical.

The ribs 276 differ somewhat from the ribs 76 in the first embodiment described above with reference to FIGS. 1–3. In particular, the ribs 276 each have a vertical, engaging end surface 277 which is generally parallel to the longitudinal axis of the vent aperture 252. This is in contrast with the ribs 76 which taper inwardly with increasing distance from the container opening (as illustrated in FIG. 3).

Further, each rib 276 includes an upper portion 279 and a lower portion 281. The upper portion 279 extends radially outwardly from the vent aperture 252 between the body deck 250 and the insert member shoulder 268. The lower portion 281 extends radially outwardly from the vent aperture 252 between the body deck 250 and the annular sealing lip 270.

The annular lip 270 terminates in a thin, radial edge which extends beyond the lower portion 281 of each rib 276 and which is normally in engagement with the lower surface 256 of the closure body deck 250.

FIG. 5 illustrates a third embodiment of the invention wherein the closure is designated generally by the reference numeral 320. The closure 320 includes a closure body which defines a deck 350 for extending over the opening of the container (not visible in FIG. 5). The deck 350 has an exterior surface 354 and an interior surface 356. The deck 350 defines a vent aperture 352 for receiving an insert member 360.

The insert member 360 defines a dispensing orifice 364 which can be occluded by a plug member 388 on a lid 384. In this embodiment, the insert member 360 includes an annular ring or shoulder 369 presenting a smooth, arcuate surface for engaging the exterior surface of the plug member 388. An outer shoulder 368 prevents the member 360 from being displaced inwardly through the body deck vent aperture 352.

The body deck 350 includes a plurality of circumferentially spaced-apart ribs 376, and the ribs 376 are similar to the second embodiment ribs 276 described above with reference to FIG. 4. However, the ribs 376 do not have a radially extending lower portion such as portion 281 illustrated in FIG. 4.

The lower surface 356 of the closure body deck 350 includes a generally annular ring or seat 371 comprising material that is unitary with, and that projects outwardly from, an adjacent flat region of the surface. This forms a valve seat around the vent aperture 352.

The insert member 360 includes an outwardly extending, annular sealing lip 370 for engaging the valve seat 371.

A fourth embodiment of the invention is illustrated in FIG. 6 wherein the closure is designated generally by the reference numeral 420. The closure 420 includes a closure body 430 which has a deck 450 for extending over the opening of the container (not visible in FIG. 4). The deck 450 has an exterior surface 454 and an interior surface 456.

Unlike the previous embodiments, the deck 450 defines two, rather than one, apertures or orifices. In particular, the deck 450 defines a vent aperture 452 and a dispensing orifice 464 which is spaced from the vent aperture 452.

The closure 420 includes a lid 484 having a plug member 488 for being sealingly received in the dispensing orifice 464 when the lid 484 is closed.

The closure body deck 450 defines a plurality of circumferentially spaced-apart ribs 476 which extend inwardly from the outer periphery of the aperture 452. An insert member 460 is mounted within the vent aperture 452 and includes a solid stem 466 engaged about its periphery by the ribs 476. At the upper end of the stem 466 is a radially extending retention shoulder 468. At the bottom end of the stem 466 is an annular sealing lip 470 for sealingly engaging the closure body deck lower surface 456 around the vent aperture 452.

The upper end of the stem 466, at the center of the annular shoulder 468, defines a recess 461. The recess 461 functions to permit the annular retention shoulder 468 to be compressed or collapsed inwardly somewhat after the member 466 has been molded and is being ejected from the mold. This facilitates release of the insert member 466 from the mold.

The remaining portions of the closure body 430 and the lid 484 are substantially identical to the closure body 30 and lid 84, respectively, described above for the first embodiment with reference to FIGS. 1–3.

It will be appreciated that when either type of closure (closure 20 illustrated in FIG. 1–3 or closure 420 illustrated in FIG. 6) is opened, the contents of the container can be dispensed through the dispensing orifice by squeezing the container. The pressure of the container contents on the inside of the closure ensures that the sealing lip is tightly engaged around the vent aperture so as to prevent the container contents from being discharged through the vent aperture passages between the ribs. The container contents are thus dispensed exclusively through the dispensing orifice.

However, when the squeezing pressure is released, the inherent resiliency of the container tends to urge the container to return to its original, undeformed condition, and this creates a sub-atmospheric pressure within the container. The differential between the ambient atmospheric pressure and the sub-atmospheric pressure causes the annular sealing lip to be deflected away from its sealing engagement position so that the ambient air can enter the container and equalize the container pressure with the ambient atmospheric pressure.

Figure 7:
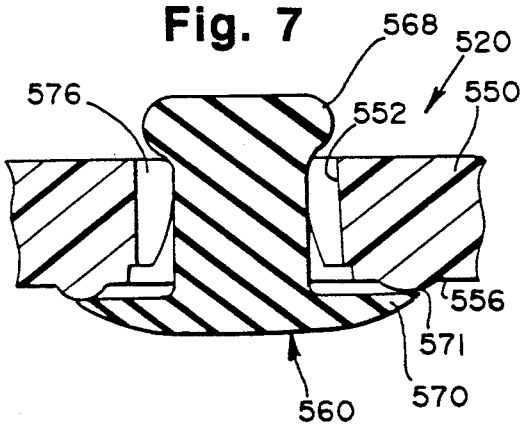
FIG. 7 is a greatly enlarged, fragmentary, cross-sectional view similar to FIG. 6 but showing a fifth embodiment of the invention.

FIGS. 7–10 illustrate modifications of the sealing member 460 employed in closure 420 described above with reference to FIG. 6. In particular, FIG. 7 illustrates a fifth embodiment wherein the closure is designated generally by the reference numeral 520. The closure 520 includes a body deck 550 having an interior surface 556 on which is defined an annular sealing ring 571.

The deck 550 defines a vent aperture 552 with ribs 576 for engaging an insert member 560 which is disposed within the vent aperture 552. The upper end of the insert member 560 has an annular retention shoulder 568, and the lower end of the insert member 560 defines an annular sealing lip 570 for engaging the valve seat 571.

Figure 8:
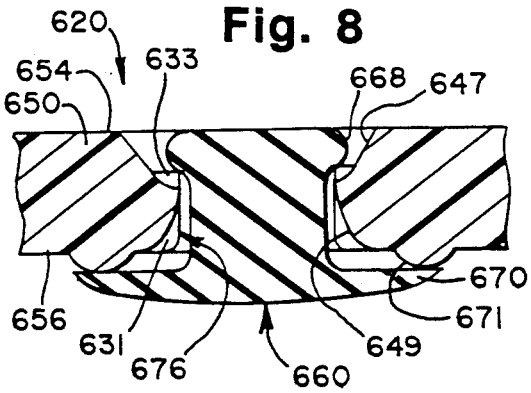
FIG. 8 is a view similar to FIG. 7 but showing a sixth embodiment of the invention.

In the sixth embodiment illustrated in FIG. 8, a closure 620 has a body deck 650 defining an exterior surface 654 and an interior surface 656. The body deck 650 includes a vent aperture defined by a frustoconical upper surface 647 and a slightly convex lower surface 649.

A plurality of circumferentially spaced-apart ribs 676 each have a lower portion 631 projecting from the convex surface 649 and an upper portion 633 projecting from the frustoconical surface 647.

An insert member 660 is disposed within the vent aperture and has an upper, annular retention shoulder 668 for engaging the rib upper portion 633. The annular retention shoulder 668 is received within the recess defined by the frustoconical surface 647 of the vent aperture, and the top of the shoulder 668 at the upper end of the insert member 660 is flush with the exterior surface 654 of the closure body deck 650.

The lower end of the insert member 660 includes an annular sealing lip 670 for engaging an annular valve seat ring 671 on the lower, interior surface 656 of the closure body deck 650.

Figure 9:
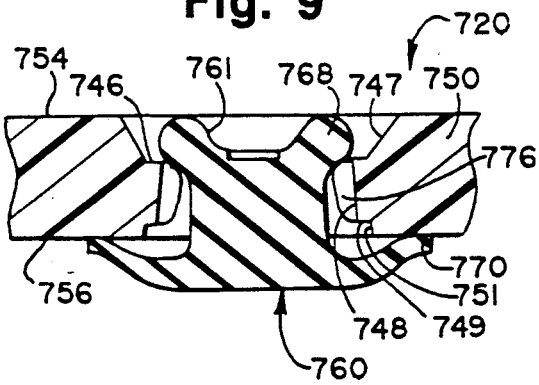
FIG. 9 is a view similar to FIG. 7 but showing a seventh embodiment of the invention.

FIG. 9 illustrates a seventh embodiment of the invention wherein the closure is designated generally by the reference numeral 720. The closure 720 includes a closure body deck 750 having an exterior surface 754 and an interior surface 756. The closure body deck 750 has a vent aperture defined by an upper, frustoconical surface 747, an upper, annular shoulder 746, an intermediate frustoconical surface 748, a lower, annular shoulder 749, and a lower frustoconical surface 751. A plurality of circumferentially spaced-apart ribs 776 project radially inwardly from the intermediate frustoconical surface 748 and engage an insert member 760.

The insert member 760 includes an annular retention shoulder 768 for engaging the upper end of each rib 776. The top of the shoulder 768 at the upper end of the insert member 760 is sized so that it does not extend beyond the upper, exterior surface 754 of the closure body deck 750.

The insert member 760 includes a central cavity or recess 761 which is defined within the upper end of the member 760 radially inwardly of the annular retention shoulder 768. This recess 761 accommodates inward compression of the shoulder 768 during removal of the insert member 760 from the mold when the insert member is manufactured.

The lower end of the insert member 760 includes an annular sealing lip 770 which is sealingly engaged with the interior surface 756 of the closure body deck 750. As can be seen in FIG. 9, the lip 770 has a somewhat ogee shape in transverse cross section.

Figure 10:
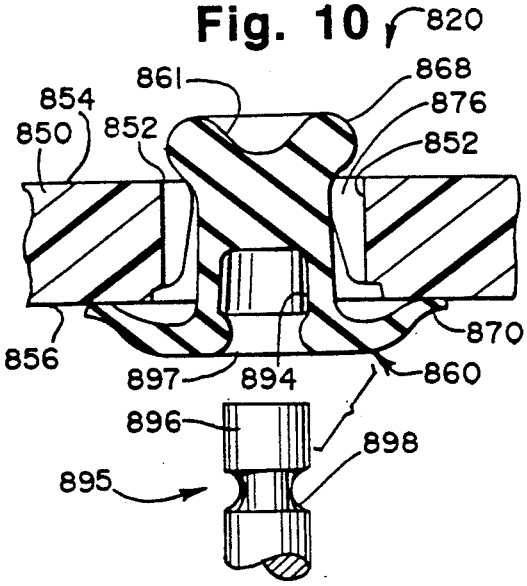
FIG. 10 is a view similar to FIG. 7 but showing an eighth embodiment of the invention.

FIG. 10 illustrates an eighth embodiment of the invention wherein the closure is designated generally by the reference numeral 820. The closure 820 includes a closure body having a deck 850 with an exterior surface 854 and an interior surface 856. The closure body deck 850 defines a generally cylindrical vent aperture 852, and a plurality of circumferentially spaced-apart ribs 876 extend radially inwardly from the outer periphery of the aperture 852.

An insert member 860 is mounted within the vent aperture 852 and has an annular retention shoulder 868 at its upper end. A recess 861 is provided in the upper end of the insert member 860 to permit compression of the insert member 860 during removal of the insert member 860 from the mold during manufacture.

The lower end of the insert member 860 includes an annular sealing lip 870 having an ogee shape in transverse cross section. The sealing lip 870 normally sealingly engages the interior surface 856 of the closure body deck 850 around the vent aperture 852.

The lower end of the insert member 860 includes a further novel feature. In particular, a recess 894 and annular shoulder 897 are defined at the bottom of the insert member 860. This structure is formed when the insert member is molded around a pin 895. The pin 895 has a head 896 and groove 898. The insert 860 is molded with the insert pin head 896 forming the recess 894 and with the pin groove 898 forming the shoulder 897. This establishes an interfering fit between the mold pin 895 and the insert member 860.

The mold pin 895 can be used to draw the insert member from the mold. The surface of the insert member sealing lip 870 can be engaged as necessary to force the sealing lip 870 off of the pin to complete ejection from the mold.

The recess 894 in the molded insert member 860 can also be used to locate and hold the insert member (e.g., with a pin similar to the pin 895) during assembly with the closure body. Specifically, the insert member 860 can be mounted on a pin, such as pin 895, and forced into the vent aperture 852. After the annular retention shoulder 868 has been properly positioned above the tops of the ribs 876, the pin can be withdrawn. The interfering fit between the insert member 860 and the pin is designed so that less force is required to disengage the pin from the insert member 860 than is required to disengage the insert member 860 from the vent aperture 852.

Further, in some applications, it may be desirable to omit the unitary ribs (e.g., ribs 76, 476, etc.) from the body deck (e.g., deck 50, 450, etc.) Instead, ribs, or similar passage-defining structures, could be molded as a part of the insert member (e.g., member 60, 460, etc.).

Other modifications can be considered as part of the present invention. For example, the insert member may incorporate an interrupted bead on peripheral, side wall, finger-like segments. Spaces can be provided between such segments to allow such segments to flex inwardly during ejection from the mold.

The closure of the present invention may be fabricated relatively easily, and the closure can be readily manufactured in a variety of designs for accommodating different sizes of dispensing orifices and venting apertures.

The closure can provide a tight seal on the container to prevent unwanted leakage or discharge of the product when the closure is in a closed orientation on the container.

Additionally, operation of the closure, from a closed to an open orientation and/or from an open to a closed orientation, is effective to clean the closure to prevent blockage or occlusion of the venting system.

It will be readily apparent from the foregoing detailed description of the invention and from the illustrations thereof that numerous variations and modifications may be effected without departing from the true spirit and scope of the novel concepts or principles of this invention.

What is claimed is:

1. A self-venting closure for an opening defined by a squeeze container to permit inspiration of ambient atmospheric air to equalize sub-atmospheric pressure in said container with the ambient atmospheric pressure and restore said container to its original shape, said closure comprising:

a closure body for being mounted to said container over said opening, said body defining a vent aperture for communicating with said container opening and defining a plurality of spaced-apart ribs projecting inwardly from the outer periphery of said aperture, said body having an interior surface for being disposed at said container opening and defining a valve seat around said aperture;

an insert member mounted to said closure body and including (1) a resilient stem extending through said vent aperture adjacent said ribs and engaged by said ribs in a fixed position relative to said ribs, (2) a shoulder at one end of said stem for engaging said closure body to prevent displacement of said insert member inwardly relative to said container opening, and (3) resilient sealing means at the other end of said stem for sealingly engaging said valve seat in a closed position and for being shifted out of sealing engagement with said valve seat to an open position when the ambient atmospheric pressure exceeds the pressure within said container to permit equalization of the container pressure with the ambient atmospheric pressure;

said insert member defining a dispensing orifice extending through said resilient stem through which the container contents can be dispensed, said vent aperture in said closure body and said stem cooperating to define passages alongside said ribs between the container opening and the ambient atmosphere for being occluded by said resilient sealing means when said resilient sealing means is in said closed position; and a lid for being moved to a closed position on said closure body and having a plug member for being sealingly received within said insert member stem to project into said dispensing orifice to occlude said orifice, said plug member being sealingly engaged by said resilient stem in said closed position.

2. The closure in accordance with claim 1 in which said stem is generally cylindrical.

3. The closure in accordance with claim 1 in which said resilient sealing means includes a resilient, annular lip.

4. The closure in accordance with claim 1 in which said shoulder is a resilient, annular flange.

5. The closure in accordance with claim 1 in which said valve seat around said vent aperture is a generally annular ring of material that is unitary with, and that projects outwardly form, an adjacent flat region of said closure body interior surface.

6. The closure in accordance with claim 1 in which said insert member is an elastomeric polymer.

7. The closure in accordance with claim 1 in which said insert member stem projects beyond the exterior of said closure body.

8. A self-venting closure for an opening defined by a squeeze container to permit inspiration of ambient atmospheric air to equalize sub-atmospheric pressure in said container with the ambient atmospheric pressure and restore said container to its original shape, said closure comprising:

a closure body for being mounted to said container over said opening, said body having an interior surface for being disposed at said container opening;

an insert member mounted in said body in a fixed position relative to said body and defining a dispensing orifice through which the container contents can be dispensed;

vent means defined by said closure body adjacent said insert member for cooperating with said insert member to define a passage between the container opening and the ambient atmosphere;

resilient sealing means defined by said insert member for sealingly engaging said closure body interior surface around said passage in a closed position and for being shifted out of sealing engagement with said interior surface when the ambient atmospheric pressure exceeds the pressure within said container to permit equalization of the container pressure with the ambient atmospheric pressure; and a lid for being moved to a closed position on said closure body and having a plug member for being sealingly received within said insert member to project into said dispensing orifice to occlude said dispensing orifice.

9. The closure in accordance with claim 8 in which said insert member has a generally annular configuration.

10. The closure in accordance with claim 8 which said closure body has a deck; and said vent means is defined by said closure body as a vent aperture through said deck.

11. The closure in accordance with claim 10 in which said closure body deck defines a plurality of spaced-apart ribs projecting inwardly from the outer periphery of said vent aperture; and said closure body deck defines a valve seat around said vent aperture.

12. The closure in accordance with claim 10 in which said insert member includes (1) a stem extending through said vent aperture and (2) a shoulder at one end of said stem for engaging said closure body to prevent displacement of said insert member inwardly relative to said container opening; and said resilient sealing means is defined by said insert member at an end of said stem opposite said shoulder, said resilient sealing means including an annular lip for sealingly engaging said valve seat in a closed position.

13. The closure in accordance with claim 8 in which said insert member includes a frustoconical surface defining a portion of said dispensing orifice for accommodating insertion of said plug member into said dispensing orifice.

14. The closure in accordance with claim 8 in which said vent means is defined as a vent aperture by said closure body, said insert member being received in said vent aperture; and said closure body defines a valve seat around said vent aperture, said valve seat being a generally annular ring of material that is unitary with, and that projects outwardly from, an adjacent flat region of said closure body interior surface.

* * * * *